United States Patent [19]

Nakamura et al.

[11] Patent Number: 4,661,051

[45] Date of Patent: Apr. 28, 1987

[54] FUEL INJECTION PUMP WITH ADJUSTABLE TIMING

[75] Inventors: Hisashi Nakamura; Noriyuki Abe, both of Higashi-Matsuyama, Japan

[73] Assignee: Diesel Kiki Co., Ltd., Tokyo, Japan

[21] Appl. No.: 796,442

[22] Filed: Nov. 8, 1985

[30] Foreign Application Priority Data

Nov. 16, 1984 [JP] Japan ..... 59-241700

[51] Int. Cl.[4] ..... F02M 59/24

[52] U.S. Cl. ..... 417/499; 417/500

[58] Field of Search ..... 417/499, 494; 123/500, 123/501, 503

[56] References Cited

U.S. PATENT DOCUMENTS 2,147,390 2/1939 Vaudet ..... 123/500
2,729,168 1/1956 Ziesche et al. ..... 417/499
3,385,221 5/1968 Parks ..... 417/494
3,712,763 1/1973 Parks ..... 417/499

*Primary Examiner*—Leonard E. Smith
*Attorney, Agent, or Firm*—Wenderoth, Lind & Ponack

[57] ABSTRACT

A fuel injection pump including an improved plunger pre-stroke adjusting mechanism which comprises a control sleeve coupled with a control rod through a coupling shaft. The coupling shaft is rotatably mounted in an aperture defined in the control rod and has an engagement portion held in engagement with the control sleeve. The engagement portion is disposed in eccentric relation to a body of the coupling shaft for translating rotating motion of the control rod into axial movement of the control sleeve, thereby adjusting the pre-stroke of a plunger. The pre-stroke adjusting mechanism thus constructed is compact and simple in construction and hence can easily be assembled.

3 Claims, 5 Drawing Figures

FIG. 2
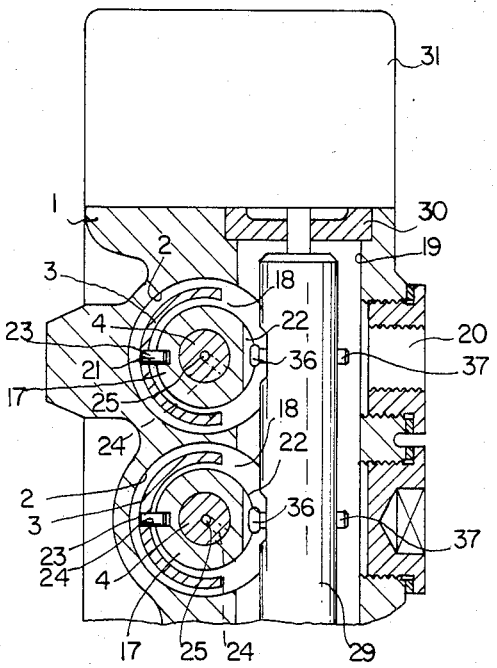
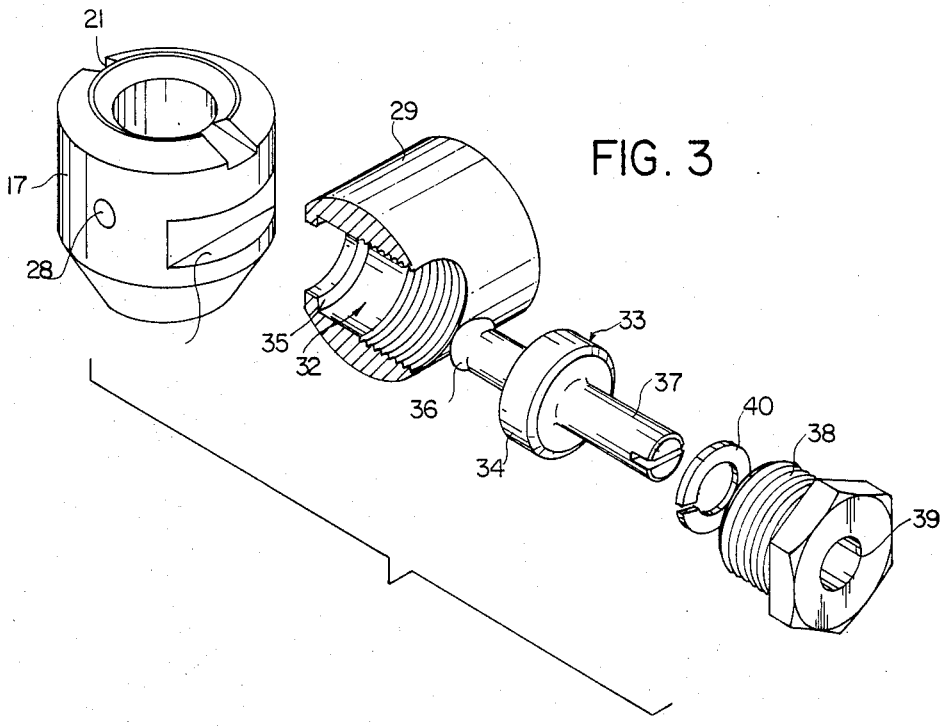
FIG. 3

FUEL INJECTION PUMP WITH ADJUSTABLE TIMING

BACKGROUND OF THE INVENTION

1. Field of the Invention:

The present invention relates to fuel injection pumps for diesel engines, and more particularly to a fuel injection pump having a pre-stroke adjusting mechanism.

2. Prior Art:

A typical example of fuel injection pump with a pre-stroke adjusting mechanism is disclosed in Japanese Utility Model Laid-open Publication No. 59-52175. As shown in FIG. 5 of the accompanying drawings, the disclosed fuel injection pump comprises a pump body 1 including a plunger barrel 3 secured thereto and a plunger 4 slidably disposed in the plunger barrel 3 and reciprocably movable in response to rotation of an engine crankshaft (not shown). The plunger 4 includes a fuel intake and discharge hole 24 defined in a portion thereof facing a fuel collecting chamber or sump 18. A control sleeve 17 is slidably fitted over the plunger 4 above the hole 24, and a control rod 29 extends normal to the axis of the control sleeve 17. A ring 41 is fitted over the control rod 29 and secured thereto by a screw 42. An engagement element 36 is secured to the ring 42 and projects radially outwardly therefrom into an engagement groove 22 in the control sleeve 17. With this arrangement, the control rod 29 is turned to angularly move the engagement element 36 whereupon the control sleeve 17 moves axially upwardly or downwardly, thereby changing its axial position with respect to the plunger 4. Thus, the distance between the control sleeve 17 and the fuel intake and discharge hole 24, i.e. the plunger pre-stroke can be regulated by turning the control rod 29 to appropriate positions.

As described above, the engagement element 36 of the known fuel injection pump is secured to the ring 41 which is in turn fitted over the control rod 29. With this construction, the diameter of the control rod 29 and the width of the ring 41 must be large enough to withstand mechanical forces applied thereto with the result that a joint portion between the control sleeve 17 and the control rod 29 is likely to become large in size. With this largeness of the joint portion, couplings 43, 44 must be detached when the control sleeve 17 and the control rod 29 are to be joined together. Then the ring 41 with the engagement element 36 mounted thereon is placed in the fuel collecting chamber 18 to bring the engagement element 36 into engagement with the engagement groove 22 in the conrtol sleeve 17. While holding the ring 41 in this position, the control rod 29 is inserted into the pump body 1 and is then fitted into the ring 41. The foregoing steps of operation must be repeated until the coupling between the control sleeve 17 and the control rod 29 is completed for all of the engine cylinders so that a simple assembling of the fuel injection pump is difficult to achieve.

SUMMARY OF THE INVENTION

It is accordingly an object of the present invention to provide a fuel injection pump having an improved pre-stroke adjusting mechanism wherein a control sleeve can easily be coupled with a control rod.

The foregoing and other objects of the present invention is attained by a fuel injection pump comprising: a pump body; a plunger reciprocably disposed in said pump body; and a pre-stroke adjusting mechanism disposed in said pump body and operatively connected with said plunger to adjust a pre-stroke of the latter, said pre-stroke adjusting mechanism including a control sleeve slidably fitted over said plunger, a control rod coupled with said control sleeve and rotatably movable to axially move said control sleeve with respect to said plunger for changing said pre-stroke, said control rod having an aperture facing a said control sleeve, and a coupling shaft rotatably mounted on said control rod and having a body portion rotatably disposed in said aperture and an engagement portion extending from said body portion and engageable with said control sleeve, said engagement portion being disposed in eccentric relation to said body portion.

Since the control sleeve and the control rod are coupled together through a coupling shaft directly fitted in the aperture in the control rod without agency of any other structural element such as the ring 41 shown in FIG. 5, an overall structure of the pre-stroke adjusting mechanism becomes compact. Because of its smallness, the control rod can be inserted in the pump body with the coupling shaft mounted thereon so as to be coupled with the control sleeve through the coupling shaft.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 2 is a fragmentary cross-sectional view taken along line A—A of FIG. 1;

FIG. 3 is an enlarged exploded perspective view of a plunger pre-stroke adjusting mechanism of the fuel injection pump shown in FIG. 1;

DETAILED DESCRIPTION

The invention is described below in greater detail with reference to a preferred embodiment shown in FIGS. 1 through 4.

Figure 1:
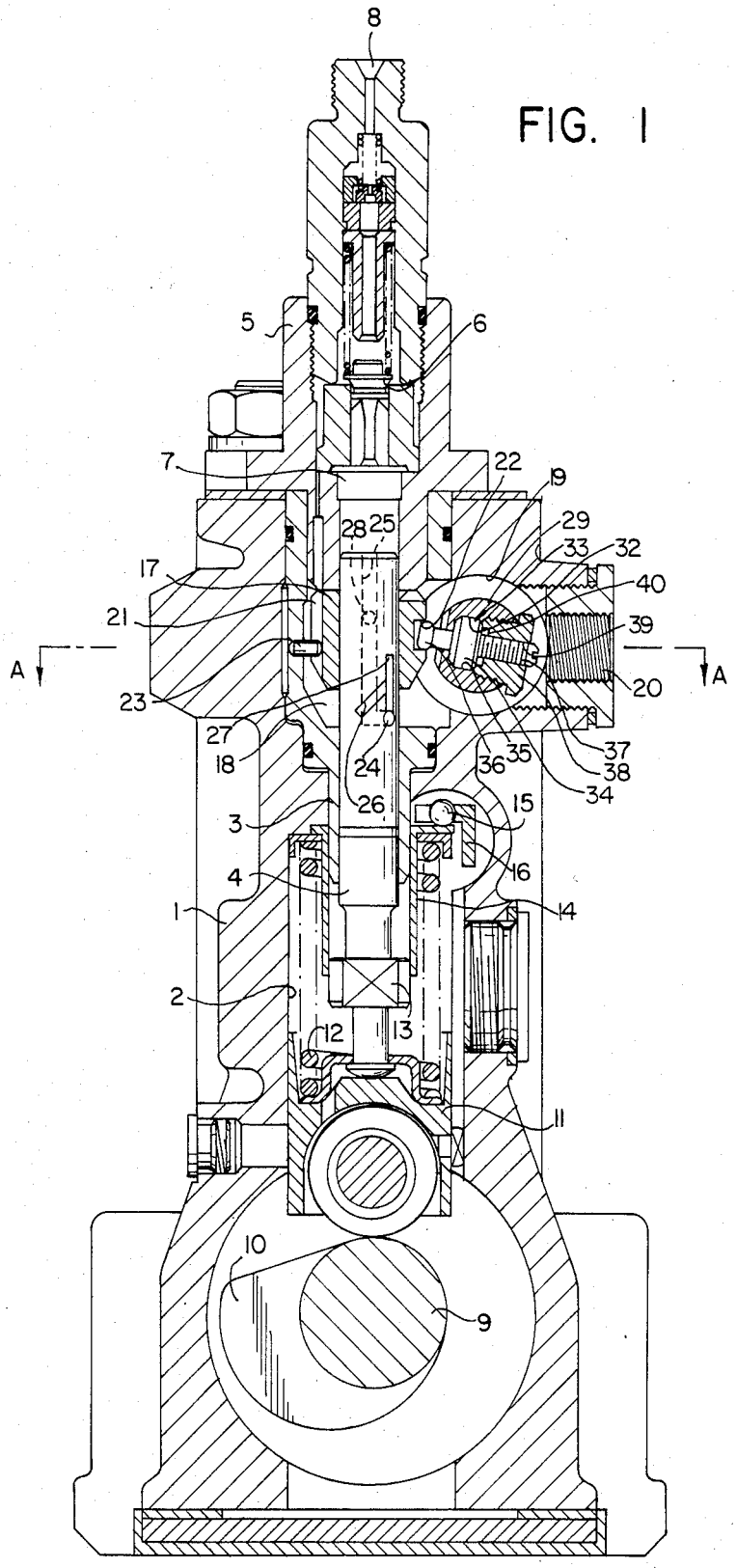
FIG. 1 is a longitudinal cross-sectional view of a fuel injection pump embodying the present invention.

As shown in FIGS. 1 and 2, a fuel injection pump comprises a pump body 1 having longitudinal bores 2 corresponding in number to the number of engine cylinders (not shown) and a plunger barrel 3 disposed in the respective bores 2 and secured to the pump body 1. A plunger 4 is slidably received in each of the plunger barrels 3. The plunger 4 has an upper end received in a valve housing 5 secured to the pump body. The valve housing 5 contains a delivery valve 6 which define jointly with the plunger 4 a fuel compression chamber 7. The fuel compression chamber 7 communicates through the delivery valve 6 with a fuel outlet 8 defined above the delivery valve 6.

The plunger 4 has a lower end held in abutment with a cam 10 on a cam shaft 9 through a tappet 11. The cam shaft 9 is connected with an engine crankshaft (not shown) for rotation in timed relation to the latter and cooperates with a spring 12 to cause the plunger 4 to reciprocate in response to a profile of the cam 10. The plunger 4 further has a face portion 13 coupled with an injection quantity adjusting sleeve 14 to limit angular movement of the latter. The sleeve 14 is connected through a projection 15 with an injection quantity adjusting rod 16 with this arrangement, the plunger 4 can be turned by moving the injection quantity adjusting rod 16 to appropriate positions.

A control sleeve 17 is disposed in a fuel collecting chamber or sump 18 defined by the plunger barrel 3 and is slidably fitted over the plunger 4. The fuel collecting chamber 18 communicates through a transverse hole 19 with a fuel inlet 20, the hole 19 and the fuel inlet 20 being defined in the pump body 1. The control sleeve 17 has a longitudinal guide slot 21 and a transverse engagement groove 22 diametrically opposite to the guide slot 21. The plunger barrel 3 has a guide pin 23 guidedly received in the guide slot 21 for only allow axial movement of the control sleeve 17. The engagement groove 22 is coupled with a control rod 29 as described below.

The plunger 4 includes a radial fuel intake and discharge hole 24 opening to the fuel collecting chamber 18, a central axial passage 25 connecting the fuel compression chamber 7 with the fuel intake and discharge hole 24, a helical groove 26 defined in the peripheral surface of the plunger 4, and a longitudinal groove 27 connecting the helical groove 26 with the fuel intake and discharge hole 24. The control sleeve 17 includes a radial cut-off hole 28.

With this construction, when the plunger 4 begins to move upwardly from the bottom dead center, as shown in FIG. 1, the fuel intake and discharge hole 24 faces to the fuel collecting chamber 18 so that the fuel compression chamber 7 communicates with the fuel collecting chamber 18 through the central axial passage 25 and the hole 24. In this condition, the fuel pressure in the fuel compression chamber 7 is not increased with the result that the delivery valve 6 remains closed. When the plunger 4 is moved upwardly until the fuel intake and discharge hole 24 is located above the lower edge of the control sleeve 17, the hole 24 is closed by the inner peripheral surface of the control sleeve 17, thereby creating an increase in fuel pressure in the fuel compression chamber 7 which in turn causes the delivery valve to open to allow fuel to flow from the fuel outlet 8 under pressure. As appears from the foregoing, a pre-stroke of the plunger 4 corresponds to a single movement of the plunger 4 between the bottom dead center and a point where the fuel intake and discharge hole 24 is fully closed by the control sleeve 17. The fuel injection takes place when the fuel intake and discharge hole 24 is closed.

Further upward movement of the plunger 4 causes the helical groove 26 to communicate with the cut-off hole 28 in the control sleeve 17 whereupon the fuel compression chamber 7 communicates with the fuel collecting chamber 18 through the axial passage 25, the radial hole 24, the longitudinal groove 27, the helical groove 26 and the cut-off hole 28, thereby allowing fuel to flow from the fuel compression chamber 7 back into the fuel collecting chamber 18. As a result that the fuel pressure in the chamber 7 decreases to thereby close the delivery valve 6. Upon communication of the helical groove 26 with the cut-off hole 28, the fuel injection ceases. A single movement of the plunger 4 between a first point where the fuel injection takes place and a second point where the fuel injection ceases, corresponds to the effective stroke of the plunger 4. The effective stroke may be varied by turning the plunger 4 by means of the injection quantity adjusting rod 16, whereas the pre-stroke can be adjusted by moving the control sleeve 17 in an axial direction by means of the control rod 29.

Figure 4:
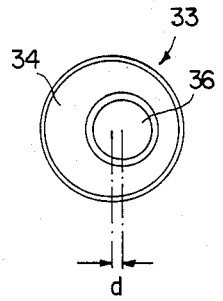
FIG. 4 is an end view of a coupling shaft employed in the plunger pre-stroke adjusting mechanism shown in FIG. 3.
Figure 5:
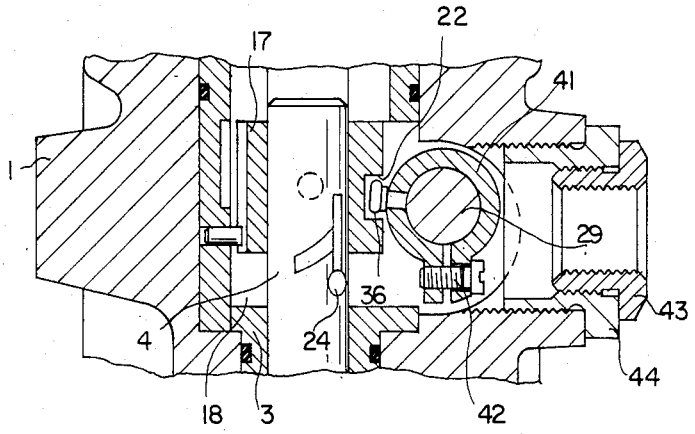
FIG. 5 PRIOR ART
FIG. 5 is a fragmentary longitudinal cross-sectional view of a fuel injection pump having a conventional plunger pre-stroke adjusting mechanism.

The control rod 29 is inserted in the transverse hole 19 and rotatably mounted on the pump body 1 by a pair of bearings 30 (only one being shown in FIG. 2). The control rod 29 is coupled with an actuator 31 such as a stepping motor and is driven by the latter to rotate about its own axis. As best shown in FIG. 3, the control rod 29 has a window or aperture 32 extending radially transversely therethrough in confronting relation to the control sleeve 17, the aperture 32 receiving a coupling shaft 33. The coupling shaft 33 includes a disc-like body portion 34 rotatably mounted in the aperture and held in abutment with an annular shoulder 35 of the control rod 29. The coupling shaft 33 further includes a first cylindrical extension extending eccentrically from the body portion 34 toward the control sleeve 17 and terminating in a barrel-shaped enlarged engagement portion 36 adapted to engage the engagement groove 22. As shown in FIG. 4, the engagement portion 36 is disposed out of alignment with the body portion 34 by the distance d. The coupling shaft 33 also has a second extension or an adjusting shank 37 extending coaxially from the body portion 34 in a direction opposite to the latter. The adjusting shank 37 extends loosely through an axial central hole 39 in a thrusting screw 38 which is threaded in the aperture 32 to retain the body portion 34 immovable within the aperture 32 with a spring washer 40 interposed between the thrusting screw 38 and the body portion 34. The adjusting shank 37 is manipulatable from the exterior side of the pump body 1 for adjusting the injection timing as described below.

The control sleeve 17 and the control rod 29 thus coupled together through the coupling shaft 33 jointly constitute a plunger pre-stroke adjusting mechanism. Upon receipt of the control signal from a control unit (not shown), the actuator 31 is driven to turn the control rod 29 either clockwise or counterclockwise, whereupon the control sleeve 17 moves upwardly or downwardly along the axis of the plunger 4. This movement causes a change in relative axial position between the plunger 4 and the control sleeve 17 with the result that the injection timing, i.e. the starting and ceasing ends of the fuel injection vary while maintaining a constant effective stroke of the plunger 4. If the cam 10 were of the non-uniform velocity type, both of the injection timing and the injection efficiency could be changed.

In assembling the pre-stroke adjusting mechanism, all the coupling shafts which correspond in number to the number of the engine cylinders are inserted into the mating apertures 32 with the spring washers 40 supported in the respective adjusting shanks 37. Then the thrusting secrews 38 are threaded to the mating apertures 32 to temporarily fasten the shafts 33 to the control rod 29. Thereafter, the control rod 29 with the coupling shafts 33 mounted thereon is inserted into the transverse hole 19 from one end thereof until each of the engagement portions 36 is brought into fitting engagement with a corresponding one of the engagement grooves 22 of the respective control sleeves 17. Since the coupling shafts 33 are directly attached to the control rod 29, the pre-stroke adjustment mechanism is compact and simple in construction and hence can be assembled with utmost ease. Because of the direct mount of the coupling shaft 33, an enlarged diameter is available for each of the control rod 29 and the coupling shaft 33, which provides an mechanically strong pre-stroke adjustment mechanism. After the assemblying, the injection timing is adjusted accurately for each engine cylinder. For adjustment, the thrusting screw 38 is loosened to a certain extent and then the adjusting shank 37 is turned by a suitable tool. Rotational movement of the shank 37 and hence the body portion 34 of the coupling shaft 33 is translated into axial movement of the control sleeve 17 through eccentric arrangement of the engagement portion 36 with respect to the body portion 34. With this eccentric arrangement, a fine adjustment of the injection timing is achieved.

Obviously many modifications and variations of the present invention are possible in the light of the above teachings. It is therefore to be understood that within the scope of the appended claims, the invention may be practiced otherwise than as specifically described.

What is claimed is:

1. A fuel injection pump comprising:

(a) a pump body;

(b) a plunger disposed in said pump body for reciprocating within said pump body;

(c) a pre-stroke adjusting mechanism disposed in said pump body and operatively connected with said plunger for adjusting an effective pre-stroke of said plunger, said pre-stroke adjusting mechanism comprising:

(1) a control sleeve fitted around said plunger for sliding along an axis of said plunger;

(2) a rotatable control rod extending in a direction normal to the axis of said control sleeve and operatively connected with said control sleeve for sliding said control sleeve along said axis of said plunger when said control rod is rotated, said control rod having an aperture extending transversely therethrough facing said control sleeve;

(3) a coupling shaft rotatably mounted on said control rod having a body portion rotatably disposed in said aperture and an engagement portion extending from said body portion for engaging said control sleeve, said engagement portion disposed in an eccentric relation to said body portion, and (4) a thrusting screw threaded in said aperature for fixing said coupling shaft relative to said control rod.

2. A fuel injection pump as claimed in claim 1 wherein, said thrusting screw having a central hole extending along it axis; and said coupling shaft having an adjusting shank coaxial with said body portion opposite said engagement portion, said adjusting shank located exterior of said pump body.

3. A fuel injection pump as claimed in claim 2 wherein, said adjusting shank is formed integrally with said body portion and engagement portion.

* * * * *